United States Patent [19]

Preston

[11] 4,124,424

[45] Nov. 7, 1978

[54] METHOD AND APPARATUS FOR MAINTAINING FABRIC FOLDS AND SHAPES DURING MANUFACTURE OF A FABRIC PRODUCT

[75] Inventor: Harold Preston, Nutley, N.J.

[73] Assignee: Automated Components Inc., Bellville, N.J.

[21] Appl. No.: 748,460

[22] Filed: Dec. 8, 1976

[51] Int. Cl.[2] ..... C09J 5/00

[52] U.S. Cl. ..... 156/155; 2/243 B; 156/204; 156/290; 156/443; 156/497; 156/548; 156/580; 428/198

[58] Field of Search ..... 2/243 R, 243 B; 156/155, 497, 285, 290, 547, 548, 204, 443, 580; 428/198

[56] References Cited

U.S. PATENT DOCUMENTS

| | | | |
|---|---|---|---|
| 3,367,822 | 2/1968 | Hoffler | 156/285 |
| 3,547,738 | 12/1970 | Matias et al. | 156/155 |
| 3,574,238 | 4/1971 | McCurry | 2/243 R |
| 3,663,964 | 5/1972 | Novak | 2/243 R |
| 3,717,528 | 2/1973 | Peerman et al. | 156/155 |
| 3,717,536 | 2/1973 | McVar et al. | 156/547 |
| 3,719,955 | 3/1973 | Hrubecky | 2/243 R |
| 3,905,860 | 9/1975 | Emus | 156/547 |

*Primary Examiner*—Edward G. Whitby
*Attorney, Agent, or Firm*—Kenyon & Kenyon, Reilly, Carr, & Chapin

[57] ABSTRACT

A method and apparatus are disclosed for forming and maintaining a fold or crease or a formed shape in or on a fabric piece while a product is being manufactured comprising the fabric. The method comprises the steps of applying an adhesive to selected locations on the fabric piece, forming the fabric piece into the desired configuration, compressing the fabric piece at the selected locations to adhere the selected locations thereof whereby the fabric piece is maintained in the formed, desired configuration during at least part of the manufacture of the product, and thereafter dissipating the adhesive. The method is especially suited to the manufacture of garments having separately attached pieces such as pockets, facings, cuffs, yokes, and the like, wherein to faciliate manufacture, the folds and creases are temporarily made in the pieces and are maintained during manufacture by the adhesive, which is dissipated in the final stages of manufacture of the garment, typically during steam pressing of the garment. The invention also includes a method for automatically picking up and discharging the fabric piece.

31 Claims, 8 Drawing Figures

METHOD AND APPARATUS FOR MAINTAINING FABRIC FOLDS AND SHAPES DURING MANUFACTURE OF A FABRIC PRODUCT

BACKGROUND OF THE INVENTION

1. Field of the Invention

The present invention relates generally to the manufacture of products comprising fabric pieces and more particularly to a method and apparatus for forming and maintaining a desired configuration in a fabric piece such as a pocket during manufacture of a product comprising the fabric such as a garment. The present invention also relates to automatically picking up and discharging a fabric piece.

2. Description of the Prior Art

Manufacture of products comprising fabric pieces usually requires that one or more fabric pieces of which the product is comprised be formed and maintained in a particular configuration while the product is being manufactured. For example, in the manufacture of garments, it is often necessary to fold and/or crease separate fabric pieces such as blanks for pockets, facings, cuffs, yokes, etc., prior to securing the piece to the garment itself. Since the fabric pieces will ultimately be secured to the garment in their folded or creased configuration and thereafter so maintained by permanent securing means such as stitching or permanent-type adhesives, it is only necessary to maintain these pieces in their folded or creased configuration up to the time that they are permanently secured to the garment. It is known to temporarily configure these fabric pieces by the simultaneous application of steam and pressure and through the use of shaping overlays such as paper. Configuring the fabric pieces using steam and pressure requires a separate step and apparatus to apply the steam and pressure in addition to forming the piece, and also requires separate cooling of the pieces thereafter. Use of overlays, of course, requires separate steps and apparatus to insert and remove the overlays. In order to automate and increase production, the fabric pieces are typically picked-up, moved and discharged by automatic pick-up apparatus. Typically, known automatic pick-up devices include means for pinching the fabric piece such as knives and serrated rollers, for example, or use a vacuum to separate the pieces. However, these devices are not entirely satisfactory because the fabric is usually porous and as a result adjacent pieces in a bundle quite often adhere when the top piece is picked up. One known method uses a roll of tape having a tacky surface to which a fabric piece is adhered and thereby picked up. The roll of tape is sequentially indexed so a fresh surface is provided for each piece. These known apparatus and methods involve relatively complex mechanisms and/or are not entirely satisfactory in performance.

In accordance with the present invention, these and other drawbacks of the prior art are obviated as well as additional advantages realized.

SUMMARY OF THE INVENTION

The present invention is embodied in and carried out by a method and apparatus for forming and maintaining a fabric piece in a desired configuration during manufacture of a product comprising the fabric piece. As used herein, fabric includes woven and non-woven fabrics. The method comprises the steps of applying an adhesive to selected locations on the fabric piece, forming the fabric piece into the desired configuration, compressing the fabric piece at the selected locations to adhere the selected locations thereof whereby the fabric piece is maintained in the formed, desired configuration during at least part of the manufacture of the product, and thereafter dissipating the adhesive. The product may consist of only the fabric piece wherein it is desired to temporarily form and maintain folds or creases therein. The product is preferably a fabric product which is preferably a garment, and the fabric pieces preferably comprise pockets, facings, cuffs yokes and the like. However, creases, facings, hems and the like in or on the fabric product itself may also be configured and maintained during manufacture. Additionally, the method is applicable to configure product accessories and to configure other products such as belts during manufacture thereof. The adhesive is preferably a liquid glue which may be dissipated preferably by the application of steam. The liquid glue is preferably applied in the form of a spray or aerosol spray immediately before configuring the fabric piece or during configuration of the fabric piece.

Further in accordance with the invention, a method is provided for automatically picking-up the fabric pieces. The adhesive is applied to at least part of a surface of the fabric pieces and the surface parts having the adhesive thereon are contacted by a pick-up device whereby a single fabric piece adheres to the pick-up device and may be lifted thereby. The pick-up device comprises means for discharging the fabric piece. Thus, adhesive is applied on each uppermost fabric piece of a bundle and each piece is thereafter automatically picked-up from the bundle and discharged in apparatus for configuring the fabric piece.

The apparatus according to the invention comprises first die means disposed in a first plane, second die means disposed in a second plane parallel to the first plane, at least one of the first and second die means comprising die members disposed in a respective die means plane and opposed at least in part, the die members being operative to be moved along the respective plane, die moving means for moving at least one of the first and second die means through coincidence of the first and second planes between positions in which the first and second planes are spaced apart, die member moving means for moving the die members along the respective plane, pressure means for selectively applying pressure between the pressure means and at least one of the first and second die means, whereby relative movement of the die means through the coincidence thereof is operative to fold at least a part of a fabric piece initially positioned between the die means, movement of the die members along the respective plane is operative to fold the said at least part of the fabric piece on itself, and the pressure means is operative to selectively apply pressure on the said at least part of the fabric piece which is folded on itself. The adhesive may be applied to the selected parts of the fabric piece after it has been placed on the apparatus and before compression, preferably before the first fold, and preferably by spraying. However, the adhesive may be applied after the first fold and before compression or before the work piece is placed on the apparatus by, for example, rolling the adhesive on the selected parts.

The die members are pivotably connected at a plurality of pivot joints and the die member moving means and pivot joints are operative to move the die members along the respective plane upon pivoting the pivot joints. Preferably, both die means comprise relatively movable die members operative to be moved in the respective plane in opposed directions.

These and other aspects of the present invention will be more apparent from the following description of the preferred embodiments thereof when considered with the accompanying drawing.

BRIEF DESCRIPTION OF THE DRAWING

The present invention is illustrated by way of example and not limitation in the figures of the accompanying drawing in which like numerals refer to like parts and in which.

DESCRIPTION OF THE PREFERRED EMBODIMENTS

The method of the invention will be illustrated by a description of the apparatus according to the invention and the operation thereof.

Figure 1:
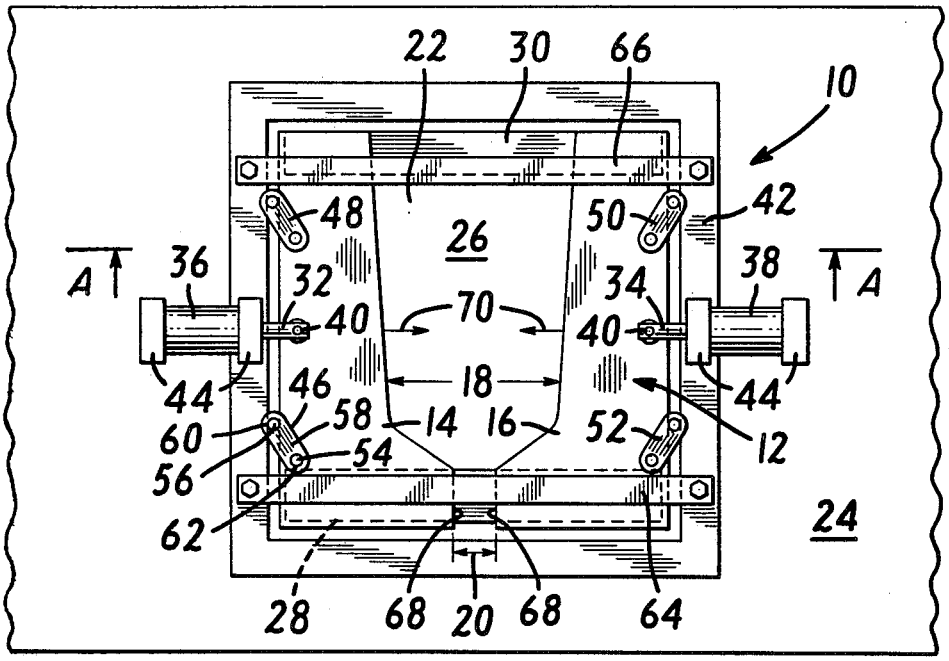
FIG. 1 is a top view of part of the apparatus according to the invention showing the bottom die assembly.

Referring to FIG. 1, lower die assembly 10 is shown and includes lower die 12. Lower die 12 comprises opposed die members 14, 16 which are identical except that they are positioned in an opposed, mirror-like relationship. The die members are somewhat L-shaped and are separated by larger space 18 and smaller space 20. The dies are positioned over opening 22 in work surface 24 in which is disposed movable pressure plate 26. The dies are supported on pressure plate 26 by spacer strips 28, 30 whereby a space is provided between the pressure plate and the dies in the area between the strips. The dies are additionally supported on strips 28, 30 for slidable movement thereon by movable plungers 32, 34 of solenoids 36, 38. Fasteners, such as, for example, pins or rods 40 engage the die members and the shafts. The rods may be secured to the plungers by, for example, a threaded arrangement which may include set screws (not shown). A rim molding 42 is positioned about the perimeter of opening 22 and secured to the work surface by fasteners such as, for example, screws (not shown). The solenoids 36, 38 are secured in known manner, for example, to the rim molding 42 and the work surface 24 by adapters 44. The die members 14, 16 are also pivotably secured by pivot joints 46, 48, 50 and 52, each of which (as illustrated by joint 46) comprises a pin or rod 54 secured to the respective die, pin or rod 56 slidably secured in a slot adjacent the rim molding for slidable movement therein and a linking member 58 having sized openings 60, 62 to accept the pins 54, 56, respectively, therein for pivotable movement of the linking member 58. Compression bars 64, 66 are positioned along opposed ends of the die members.

Movement of the lower die members inwardly in opposed directions indicated by arrows 70 into a contracted position (not shown) is accomplished by supplying (not shown) an electric control signal to the solenoids to cause the plungers thereof to extend outwardly therefrom. As a result, pins 56 slide in their respective slots as the linking members 58 pivot about the pins, and the linking members are extended to be parallel (not shown) to the compression bars 64, 66. The lower ends 68 of the die members are abutting each other (not shown) after the dies are contracted.

Figure 2:
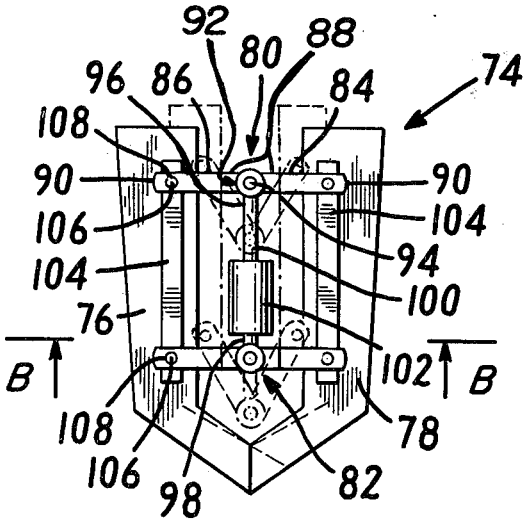
FIG. 2 is a top view of part of the apparatus according to the invention showing the top die assembly, and showing the retracted position of the inner edges of the die in phantom.

Referring now to FIG. 2, upper die assembly 74 is shown and includes opposed die members 76, 78. The die members are pivotably joined by pivot means 80, 82, both of which are identical. Each comprises a pair of linking members 84, 86 which are pivotably joined at one of their respective ends 88 to each other and each is pivotably joined at its other end 90 to one of the upper die members. The linking members are joined together at pivot joint 92 by pins or rods 94 which are also fixedly secured to opposed ends 96, 98 of the plunger 100 of solenoid 102. The plunger and linking members may be secured, for example, by threading opposed ends of the pins and threadedly securing nuts thereon. The other ends 90 of the linking members are pivotably secured to bars 104 which are fastened to the die members by pins 106 secured to the bars and sized for permitting pivotal movement of the linking member through holes 108 about the pins. The die members 76, 78 are shaped so that their perimeter corresponds generally to the shape of space 18 between die members 14, 16 and are spaced apart so that the die members 74, 76 may be contracted or moved inwardly.

Movement of the upper die members inwardly is accomplished by supplying (not shown) an electrical control signal to the solenoid 102 to cause the plunger thereof to move downwardly relative to the face of the drawing. This causes the linking members to pivot to the position shown by the broken lines which in turn cause the die members to contract to the position shown by the broken lines. The die members move inwardly and, relative to the face of the drawing, upwardly. Thus, the expanded and contracted positions of the die members shown in FIG. 2 are offset.

Figure 3:
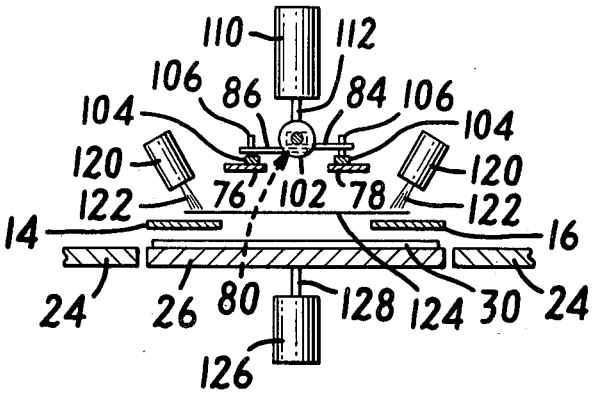
FIGS. 3–7 are diagrammatic sectional views taken along lines A—A and B—B of the apparatus of FIGS. 1 and 2 and show diagrammatically the operation of the apparatus of FIGS. 1 and 2 for practicing the method according to the invention.
Figure 4:
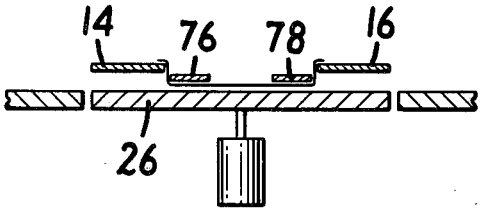

The upper die assembly is supported by a bracket (not shown) or other suitable means above the lower die assembly and includes another solenoid 110 (FIG. 3) for moving the upper die members downwards through and between the lower die member as shown in FIG. 4. The solenoid 110 is secured to the bracket in known manner (not shown) and the die member and solenoid 102 are secured to the plunger 112 of solenoid 110 in known manner.

Referring now to FIGS. 3 to 7 which show diagrammatically parts of the preferred embodiment of the apparatus according to the invention, operation of the preferred embodiment of the invention will be described. In FIG. 3 is shown means 120 for spraying an adhesive 122 on selected parts of a work piece 124. In the preferred embodiment, the adhesive is a liquid glue which is dispensed in an aerosol spray. One such liquid glue which may be dissipated by steam is commerically available from the Mellon Corporation and is designated by the number 345. Pressure plate 26 is moved into and out of compressive engagement with die members 14, 16 by solenoid 126, the plunger 128 of which is connected to the pressure plate. Parts not essential to an understanding of the operation of the invention have been omitted from FIGS. 3–7 for the sake of clarity and particularly from FIGS. 4–7.

Figure 5:
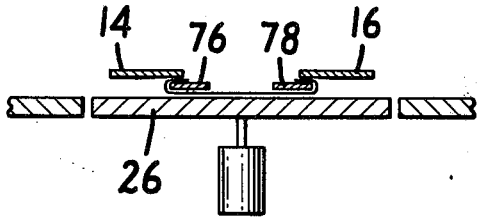
Figure 6:
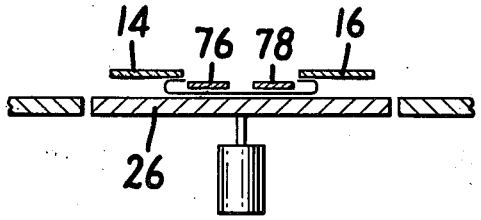
Figure 7:
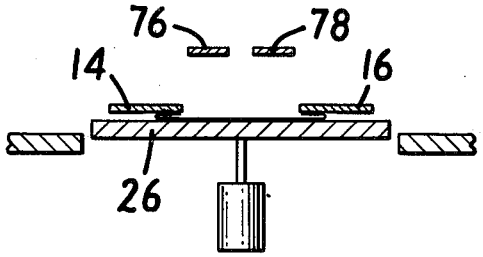

In FIG. 3, work piece 124 in the form of a pocket blank is placed over lower die members 14, 16 which are in an expanded position. Upper die members 76, 78 also in an expanded position, are lowered through the lower die members as shown in FIG. 4 to cause the pocket blank to fold along its edges so that a portion lies vertically between the upper and lower die members. The lower die members 14, 16 are contracted as shown in FIG. 5 to cause the edges of the pocket blank to be folded over the upper die members 76, 78 to somewhat enclose the upper die members. The upper die members are next contracted as shown in FIG. 6 and may be elevated to the starting position of FIG. 3 while the pressure plate is moved upwardly against the lower die members to compress the pocket blank edges therebetween as shown in FIG. 7. Bars 64, 66 (FIG. 1) hold the lower dies in place against the force of plate 26. Adhesive is sprayed on the pocket blank edges preferably while the pocket blank is in the flat, unfolded position of FIG. 3, but may also be sprayed in the positions shown in FIGS. 4 and 6 or applied before the piece is placed in the lower die assembly. After the pressure plate is moved out of engagement with the lower die members, the configured and adhered pocket blank is removed, the dies moved again to the position of FIG. 3, another pocket blank is positioned, and the cycle repeated. The pocket blank may not be stitched or otherwise permanently secured to a garment in its adhered configuration.

The adhesive may be dissipated in the final stages of manufacture of the product, or essentially after manufacture of the product, or even while the product is in use by, for example, normal laundering, dry cleaning or use in an environment which will dissipate the adhesive. Accordingly, means for dissipating the adhesive may be located remotely from the remainder of the apparatus for configuring the fabric piece and remotely from the manufacture of the product itself. With respect to garments, however, it is preferred that the adhesive be dissipated during steam pressing of the garment.

Preferably, the pocket blanks are stacked in a bundle and are individually automatically removed therefrom and discharged in the lower die assembly according to the invention. In accordance with this aspect of the invention, adhesive is applied to each pocket blank while it is on top of the bundle by spraying predetermined parts of the blank. A pick-up device contacts the sprayed parts of the blank causing the blank to adhere to the pick-up device which lifts the blank from the bundle. The pick-up device comprises a planar surface which contacts the sprayed parts of the blanks and another part which is operative to discharge the blank. In a preferred embodiment, the blanks are sprayed with adhesive along a border about their periphery and the pick-up device comprises a planar surface in its lower surface along its periphery sized in accordance with the pocket blank border. The pick-up device comprises in its inner lower surface apertures communicated with an air source whereby air is used to discharge the adhered blanks. In an alternate embodiment, the central portion and periphery planar surface portion of the pick-up device are movable with respect to each other whereby the portions are moved so that the central portion protrudes through the periphery portion to discharge the pocket blank. Means are provided for moving the pick-up device and for relatively moving the central and periphery parts of the pick-up device.

Figure 8:
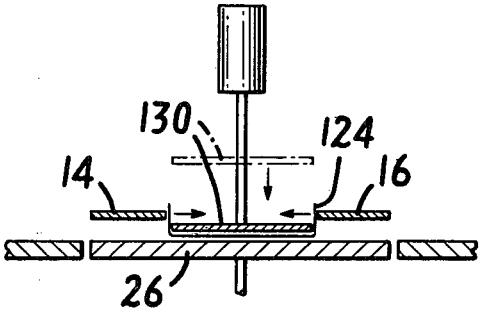
FIG. 8 is a diagrammatic sectional view similar to those of FIGS. 3–7 showing another embodiment of the apparatus according to the invention.

Referring now to FIG. 8, another embodiment of the invention is shown. In FIG. 8, upper die 130 comprises a single die member which is moved from its starting position referenced by broken lines through lower die members 14, 16 to fold the pocket blank 124 as shown. The upper die is moved back to the starting position and the lower die members are contracted to fold the edges of the pocket blank over the pocket blank (not shown). The pressure plate 26 and lower dies are then moved into compressive engagement (not shown) and the lower die members are thereafter expanded and the blank removed.

The invention has been illustrated by way of example and it is not intended that the invention be so limited as certain changes and modifications may be made thereto without departing from the spirit and scope of the invention. For example, while a steam dissipated adhesive is preferred, many adhesives may be employed and they may be dissipated by means other than steam. Also the adhesive may be applied by means other than spraying and aerosol spraying. For example, the adhesive may be rolled on or applied by brushes or vibrated onto the fabric piece. With respect to the fabric piece and the product, fabric pieces other than those specifically disclosed may be configured and adhered and they and the invention may be used for products other than garments. For example, fabric pieces may be adhered to goods such as luggage, bags and other items for carrying things, as well as to such diverse products as tents, etc. Moreover, the product itself need not be completely comprised of fabric. For example, the fabric pieces configured according to the invention may be adhered to leather and plastic goods. Also, the fabric piece need not be separate from the product as the invention may be practiced by folding hems, or creases and the like on a fabric product itself, as was mentioned hereinbefore. Additionally, with respect to moving the die assemblies and die members, it is intended to cover by the claims pivot joints other than those described in the preferred embodiments and moving means other than solenoids (such as, for example, linear motors, fluid actuated devices, etc.). And with respect to the die assemblies and members, it is also intended to cover by the claims die assemblies and members other than those illustrated as preferred embodiments which fall within the spirit and scope of the invention.

The advantages of the present invention, as well as certain changes and modification of the disclosed embodiments thereof, will be readily apparent to those skilled in the art. It is the applicant's intention to cover by his claims all those changes and modifications which could be made to the embodiments of the invention herein chosen for the purposes of the disclosure without departing from the spirit and scope of the invention.

What is claimed is:

1. A method for forming and maintaining a fabric piece in a desired configuration during manufacture, comprising the steps of applying adhesive to at least one surface of the fabric piece at least at selected locations thereof, forming the fabirc piece into the desired configuration in which parts of said surface including said selected locations with adhesive thereon are opposed and bringing together at least said parts of said surface which are opposed under sufficient pressure to cause said adhesive to adhere said parts of said surface together, and thereafter dissipating the adhesive.

2. The method of claim 1, wherein the adhesive is applied before forming of the fabric piece into the desired configuration.

3. The method of claim 1, wherein the adhesive is applied during forming of the fabric piece into the desired configuration.

4. The method of claim 1, wherein the fabric piece is maintained in the desired configuration during manufacture of a fabric product comprised of the fabric piece.

5. The method of claim 1, wherein the adhesive is dissipated by the application of steam.

6. The method of claim 1, wherein the adhesive is liquid glue.

7. The method of claim 6, wherein the liquid glue is sprayed on the selected locations of the fabric piece.

8. The method of claim 4, wherein the fabric piece and the fabric product comprise a single fabric piece.

9. The method of claim 4, wherein the fabric piece is separate from the fabric product.

10. The method of claim 4, wherein the fabric piece comprises a fabric pocket blank and the fabric product comprises a garment.

11. The method of claim 4, wherein the fabric piece is chosen from the group consisting of pocket blanks, facings, cuffs, and yokes.

12. The method of claim 1 and further comprising automatically picking up each fabric piece from a first location and discharging it in a second location, wherein fabric piece locations having adhesive thereon are contacted by a pick-up surface to adhere the fabric piece to the pick-up surface by means of the adhesive and thereafter at a second location separating the fabric piece from the pick-up surface by applying sufficient force therebetween to overcome the adhesive force adhering the fabric piece to the pick-up surface to discharge the fabric piece.

13. The method of claim 12, wherein the fabric piece is picked-up from a bundle and discharged into apparatus for forming the fabric piece.

14. The method of claim 12, wherein the fabric piece is picked-up from said apparatus and discharged elsewhere.

15. A method for automatically picking up and discharging a fabric piece comprising applying an adhesive to selected locations on the fabric piece, contacting the selected locations by a pick-up surface to adhere the fabric piece to the pick-up surface and separating the fabric piece from the pick-up surface by applying sufficient force therebetween to overcome the adhesive force adhering the fabric piece to the pick-up surface to discharge the fabric piece.

16. The method of claim 15, wherein the fabric piece is picked up from the top of a bundle of fabric pieces and discharged in an apparatus for forming the fabric piece into a desired configuration.

17. The method of claim 15, wherein air pressure is used to overcome the adhesive force.

18. The method of claim 15, wherein a mechanically applied force is used to overcome the adhesive force.

19. A method for forming and temporarily maintaining a fabric piece in a folded configuration comprising the steps of applying liquid glue to a selected surface of the fabric piece at selected locations thereof, folding the fabric piece into the folded configuration so that at least the selected locations of the selected surface having glue applied thereto oppose other parts of the selected surface, and bringing together the parts of the selected surface that are opposed under sufficient pressure to cause the glue to adhere those parts of the folded, selected surface in contact with the glue, and thereafter dissipating the glue with steam.

20. A method for forming and maintaining a fabric piece in a desired configuration during manufacture, comprising the steps of applying a dissipable adhesive to at least one surface of the fabric piece at least at selected locations thereof, forming the fabric piece into the desired configuration in which parts of said surface including said selected locations with adhesive thereon are opposed and bringing together at least said parts of said surface which are opposed under sufficient pressure to cause said adhesive to temporarily adhere said parts of said surface together during manufacture of the fabric piece.

21. the method of claim 20 and further comprising the step of thereafter dissipating the adhesive.

22. A method for forming and temporarily maintaining a fabric piece in a folded configuration comprising the steps of applying liquid glue dissipable by steam to a selected surface of the fabric piece at selected locations thereof, folding the fabric piece into the folded configuration so that at least the selected locations of the selected surface having glue applied thereto oppose other parts of the selected surface, and bringing together the parts of the selected surface that are opposed under sufficient pressure to cause the glue to adhere those parts of the folded, selected surface in contact with glue.

23. The method of claim 22 and further comprising the step of thereafter dissipating the glue with steam.

24. Apparatus for forming and maintaining a fabric piece in a desired configuration comprising:

(a) adhesive applying means for applying an adhesive to at least one surface of the fabric piece at least at selected locations thereof;

(b) forming means for forming the fabric piece into the desired configuration in which parts of said surface including said selected locations with adhesive thereon are opposed;

(c) pressure means for bringing together at least said parts of said surface which are opposed under sufficient pressure to cause said adhesive to adhere said parts of said surface together; and (d) means for dissipating the adhesive.

25. The apparatus of claim 24, wherein the adhesive is a glue dissipable by steam.

26. The apparatus of claim 24, wherein the forming means comprises first and second die means disposed in respective parallel planes operative to be moved from a first spaced apart position through coincidence of the respective parallel planes to a second spaced apart position, said first and second die means each comprising a pair of die members diposed in a respective die means plane and opposed at least in part, the die members being operative to be moved along the respective plane, whereby relative movement of the die means through the coincidence thereof is operative to fold at least a part of a fabric piece initially positioned between the first and second die means and movement of the die members along the respective plane being operative to fold the said at least part of the fabric piece on itself, the forming means further comprising means for moving the die members along the respective plane including for moving the die members of one of the die means activator means including a member movable in a first direction, and linking means linking said member and said die members for moving said die members in a direction substantially transverse to the first direction, said linking means comprising a plurality of linking members, first pivot means pivotally connecting at least one linking member with each of said die members and second pivot means pivotally connecting said member with each of said at least one linking member.

27. The apparatus of claim 26, wherein the dissipating means is operative to provide steam to dissipate the adhesive.

28. The apparatus of claim 26, wherein the dissipating means is located remotely from the remainder of said apparatus.

29. Apparatus for forming and temporarily maintaining a fabric piece in a desired configuration during manufacture of the fabric piece comprising:

(a) adhesive applying means for applying a dissipable adhesive to at least one surface of the fabric piece at least at selected locations thereof;

(b) forming means for forming the fabric piece into the desired configuration in which parts of said surface including said selected locations with adhesive thereon are opposed; and (c) pressure means for bringing together at least said parts of said surface which are opposed under sufficient pressure to cause said adhesive to adhere said parts of said surface together, whereby said fabric piece may be maintained in the desired configuration during manufacture thereof.

30. The apparatus of claim 29 and further comprising dissipating means for dissipating the adhesive.

31. Die apparatus comprising opposed die members disposed along a common plane and die member moving means for moving said members along the plane, said die member moving means comprising actuator means including a member movable in a first direction and linking means linking said member and said die members for moving said die members in a direction substantially transverse to the first direction, said linking means comprising a plurality of linking members, first pivot means pivotally connecting at least one linking member with each of said die members and second pivot means pivotally connecting said members with each of said at least one linking member.

* * * * *

UNITED STATES PATENT AND TRADEMARK OFFICE

CERTIFICATE OF CORRECTION

PATENT NO. : 4,124,424

DATED : November 7, 1978

INVENTOR(S) : Harold Preston

It is certified that error appears in the above-identified patent and that said Letters Patent are hereby corrected as shown below:

Column 2, line 11
After "cuffs" insert -- , --.

Column 3, line 59
After "die," insert -- a --.

Column 6, line 60
Change "fabirc" to -- fabric --.

Column 8, line 17
Change "the" to -- The --.

Column 8, line 30
After "with" insert -- the --.

Column 8, line 45
Change "surface" to -- surfaces --.

UNITED STATES PATENT AND TRADEMARK OFFICE

CERTIFICATE OF CORRECTION

PATENT NO. : 4,124,424

DATED : November 7, 1978

INVENTOR(S) : Harold Preston

It is certified that error appears in the above-identified patent and that said Letters Patent are hereby corrected as shown below:

Column 8, line 55
Change "diposed" to -- disposed --.

Column 10, line 22
Change "members" to -- member --.

Signed and Sealed this

*Third* Day of *April 1979*

[SEAL]

*Attest:*

RUTH C. MASON
*Attesting Officer*

DONALD W. BANNER
*Commissioner of Patents and Trademarks*